US008540929B2

(12) United States Patent
Irie et al.

(10) Patent No.: US 8,540,929 B2
(45) Date of Patent: Sep. 24, 2013

(54) METHOD FOR PRODUCING RARE EARTH SINTERED MAGNET

(75) Inventors: Shuichiro Irie, Chuo-ku (JP); Raitaro Masaoka, Chuo-ku (JP); Toshiya Hozumi, Chuo-ku (JP); Tetsuya Chiba, Chuo-ku (JP)

(73) Assignee: TDK Corporation, Tokyo (JP)

( * ) Notice: Subject to any disclaimer, the term of this patent is extended or adjusted under 35 U.S.C. 154(b) by 325 days.

(21) Appl. No.: 12/951,325

(22) Filed: Nov. 22, 2010

(65) Prior Publication Data

US 2011/0121498 A1 May 26, 2011

(30) Foreign Application Priority Data

Nov. 25, 2009 (JP) ..... 2009-267581
Sep. 28, 2010 (JP) ..... 2010-217156

(51) Int. Cl.
*B28B 3/20* (2006.01)

(52) U.S. Cl.
USPC ..... 264/638; 264/639

(58) Field of Classification Search
USPC ..... 264/638, 639
See application file for complete search history.

(56) References Cited

U.S. PATENT DOCUMENTS

| | | | | |
|---|---|---|---|---|
| 2,778,807 | A * | 1/1957 | Boggs et al. | 524/484 |
| 5,666,635 | A | 9/1997 | Kaneko et al. | |
| 6,274,080 | B1 * | 8/2001 | Tang et al. | 264/638 |
| 6,602,942 | B1 * | 8/2003 | Karato | 524/474 |
| 6,800,689 | B2 * | 10/2004 | Inagaki et al. | 525/98 |
| 7,214,343 | B2 | 5/2007 | Kuniyoshi et al. | |
| 2001/0051246 | A1 * | 12/2001 | Iwasaki et al. | 428/66.6 |
| 2005/0133117 | A1 * | 6/2005 | Tayu et al. | 148/105 |
| 2006/0099404 | A1 * | 5/2006 | Yoshimura et al. | 428/323 |
| 2009/0270525 | A1 * | 10/2009 | Yamamoto et al. | 521/140 |
| 2009/0272600 | A1 * | 11/2009 | Okabe et al. | 181/227 |
| 2011/0245062 | A1 * | 10/2011 | Hayakawa | 501/1 |
| 2012/0276310 | A1 * | 11/2012 | Andersen et al. | 428/34.1 |

FOREIGN PATENT DOCUMENTS

| | | |
|---|---|---|
| CN | 1500021 | 5/2004 |
| EP | 0 659 508 | 6/1995 |
| EP | 1 386 681 | 2/2004 |
| JP | 8-167515 | 6/1996 |
| JP | 9-283358 | 10/1997 |

* cited by examiner

*Primary Examiner* — Joseph S Del Sole
*Assistant Examiner* — Russell Kemmerle, III
(74) *Attorney, Agent, or Firm* — Drinker Biddle & Reath LLP

(57) ABSTRACT

The present invention relates to a method for producing a rare earth sintered magnet including the steps of: molding a mixture of magnetic powder containing a rare earth compound and oil-extended rubber containing oil and rubber to produce a molded body; removing the oil-extended rubber from the molded body; and calcining the molded body from which the oil-extended rubber is removed to produce a rare earth sintered magnet 10.

6 Claims, 1 Drawing Sheet

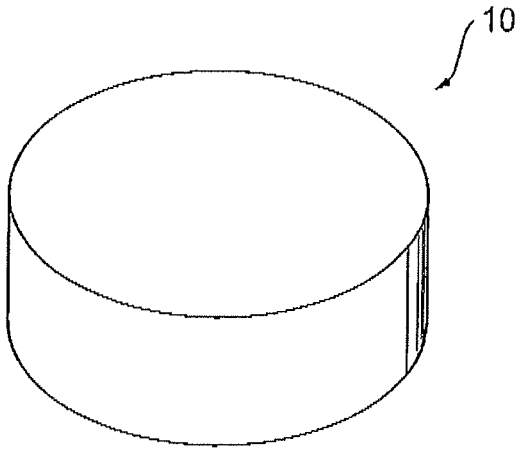
10

METHOD FOR PRODUCING RARE EARTH SINTERED MAGNET

BACKGROUND OF THE INVENTION

1. Field of the Invention

The present invention relates to a method for producing a rare earth sintered magnet.

2. Related Background Art

Rare earth sintered magnets are typically produced by press molding raw materials having specific compositions to produce molded bodies and then calcining the molded bodies. Wet molding using slurry as a raw material for producing a molded body is developed as a method for producing a rare earth sintered magnet in order to, for example, improve the magnetic properties. The main factor of using this technique is that wet molding can improve the uniformity of magnetic powder as compared with dry molding. As described above, the production condition of a molded body largely affects the properties of a rare earth sintered magnet.

Typically, for producing an anisotropic rare earth sintered magnet by the wet molding technique as described above, molding in a magnetic field by which a material is applied with a magnetic field while being pressurized is performed to produce a molded body in which the magnetic particles are oriented by the magnetic field in a predetermined direction. During this process, binding between the magnetic powder particles and a magnetic field orientation are simultaneously performed.

A technique for performing injection molding after a thermoplastic binder and magnetic powder are kneaded is developed as another method for producing a molded body for a rare earth sintered magnet (for example, see Patent document 1). Typically, a kneaded product needs to be heated during molding in such a production method.

[Patent document 1] Japanese Unexamined Patent Publication No. JP-A-H9-283358

SUMMARY OF THE INVENTION

When a molded body is produced by the molding in a magnetic field using slurry as described above, the magnetic powder particles need to be bound to each other while being applied with a magnetic field. Therefore, the movement of the magnetic powder particles is limited, and thus, it is difficult to obtain a sufficiently high degree of orientation. Moreover, when magnetic fields are oriented in the pressing direction, it is further difficult to increase the degree of orientation.

Such a method of Patent document 1 requires heating during injection molding, and therefore, production process and production equipment become complex. Moreover, it is concerned that magnetic powder is oxidized by the heating process to reduce the magnetic properties of a rare earth sintered magnet.

It is therefore an object of the present invention to provide a method for producing a rare earth sintered magnet that can produce a molded body at room temperature and can easily produce a rare earth sintered magnet having excellent residual magnetic flux density.

The present invention provides a method for producing a rare earth sintered magnet comprising the steps of molding a mixture of magnetic powder containing a rare earth compound and oil-extended rubber containing oil and rubber to produce a molded body; removing the oil-extended rubber from the molded body; and calcining the molded body from which the oil-extended rubber is removed to produce a rare earth sintered magnet.

The production method of the present invention can produce a molded body at room temperature and can easily produce a rare earth sintered magnet having excellent residual magnetic flux density. The following factors are cited as reasons for bearing such effects. The production method of the present invention produces a molded body using a mixture including oil-extended rubber and thus can easily produce a molded body having a desired shape without heating. Therefore, the production equipment can be simplified and oxidization of magnetic powder can be sufficiently suppressed. Moreover, a molded body can be formed without pressurization, and thus, magnetic particles are easily oriented in order during molding in a magnetic field. Therefore, a rare earth sintered magnet having a high degree of orientation can be obtained. Such factors enable easy production of a rare earth sintered magnet having excellent residual magnetic flux density. The factors bearing the effects of the present invention are not limited to the description as described above.

In the molding in the production method of the present invention, the molded body is preferably produced by extrusion-molding the mixture. The extrusion molding enables easy mass-production of rare earth sintered magnets having various shapes and excellent residual magnetic flux density. Moreover, the extrusion molding promotes an increase in the yield of the production of rare earth sintered magnets.

The rubber used in the production method of the present invention is preferably made of a polymer containing no oxygen as a constituent element. This enables oxidization of a rare earth compound to be sufficiently suppressed in the removing of the oil-extended rubber, and thus, a rare earth sintered magnet further excellent in magnetic properties can be produced.

The rubber used in the production method of the present invention is further preferably made of a polymer in which bonds between carbons are only single bonds. This enables the carbon amount remaining in the rare earth sintered magnet to be sufficiently reduced, and thus, the magnetic properties of the rare earth sintered magnet can be further improved.

The content of the magnetic powder in the mixture in the production method of the present invention is preferably 80 to 95% by mass. The mixture containing the magnetic powder within such a range can be easily kneaded and has moderate shape retainability. Therefore, molding can be more easily performed by extrusion molding.

Moreover, the removing of the oil-extended rubber in the production method of the present invention preferably comprises the steps of removing mainly the oil from the molded body by heating the molded body, and removing mainly the rubber from the molded body by heating the molded body. The content of carbon remaining in the rare earth sintered magnet can further be reduced by dividing the removing of the oil-extended rubber into the two processes as described above, This enables production of a rare earth sintered magnet having further excellent coercive force.

According to the invention, it is possible to provide a method for producing a rare earth sintered magnet that can produce a molded body at room temperature and that can easily produce a rare earth sintered magnet having excellent residual magnetic flux density.

BRIEF DESCRIPTION OF THE DRAWINGS

FIG. 1 is a perspective view showing an example of a rare earth sintered magnet obtained by a production method of an embodiment of the present invention.

DESCRIPTION OF THE PREFERRED EMBODIMENTS

Exemplary embodiments of the present invention will be described occasionally with reference to the accompanying drawing.

The production method of an embodiment of the present invention comprises the steps of: preparing oil-extended rubber containing oil and rubber and magnetic powder containing a compound including a rare earth element (rare earth compound); kneading the magnetic powder and the oil-extended rubber to prepare a clayey kneaded product; molding the kneaded product to produce a molded body; removing the oil-extended rubber for removing the oil and the rubber from the molded body; and calcining the molded body from which the oil and the rubber are removed to produce a rare earth sintered magnet. The detail of each of the processes is described below.

In the preparing, oil-extended rubber containing oil and rubber is prepared. The oil-extended rubber can be obtained by mixing rubber and oil to make the rubber absorb the oil. The oil-extended rubber is preferably in a state where the rubber is saturated with the oil. Specifically, the mass ratio of the oil relative to the rubber is preferably 4 or more, and more preferably 5 to 7. When the mass ratio of the oil relative to the rubber is too large, the clayey kneaded product becomes sticky, and thus, its handling tends to be difficult. In contrast, when the mass ratio of the oil relative to the rubber is too small, the kneaded product does not become clayey. As a result, the shape retainability of the kneaded product is impaired, and thus it tends to be difficult to perform extrusion molding.

Prior to mixing the oil and the rubber, a solution is preferably prepared by dissolving the rubber into an organic solvent such as toluene. The oil-extended rubber can be easily produced by dissolving the rubber into an organic solvent in such a manner. The mass ratio of the organic solvent relative to the rubber is preferably 5 to 20, and more preferably 10 to 20. When the mass ratio is less than 5, it tends to be difficult to dissolve the rubber sufficiently. In contrast, when the mass ratio exceeds 20, the removal of the solvent tends to take a long time. Preferably the used organic solvent is mixed with the rubber and the oil, and then the heat is applied and/or the pressure is reduced to remove the organic solvent from the mixture, to prepare the oil-extended rubber in which the content of the organic solvent is sufficiently reduced.

Various lubricating oils such as mineral oils, synthetic oils, vegetable oils, and animal oils are applicable to the oil. Preferable examples of the oil include hydrocarbon oils such as poly-α-olefin, carboxylic acids, and fatty acids, and specifically, isoparaffin.

Common synthetic rubber is applicable to the rubber. Rubber containing no oxygen in its chemical structure, that is, rubber containing no oxygen as an element constituting the polymer of the rubber is preferred in terms of suppressing oxidization of the rare earth compound. Moreover, the rubber is preferably made of polymers having no double bond and/or aromatic ring, and more preferably made of polymers in which the bonds between carbons are all single bonds, in terms of reducing the carbon content remaining in the rare earth sintered magnet. Examples of the polymers include polymers having polymethylene chains in their main chains (chains in which, for example, 10 or more methylene groups are coupled to each other). Rubber containing no sulfur as an element constituting the polymer of the rubber is preferred in terms of preventing deterioration of the properties due to sulfidation.

Specific examples of the rubber include polyisobutylene (PIB), ethylene-propylene rubber (RPM), styrene-butadiene rubber (SBR), butadiene rubber (BR), isoprene rubber (IR), butyl rubber (IIR), and ethylene-propylene diene monomer (EPDM) rubber. Among them, PIB and EPM are preferred in terms of reducing the carbon content remaining in the rare earth sintered magnet.

The magnetic powder can be prepared by the following procedures. A composition containing a rare earth element (R), iron (Fe), boron (B), and an optional element at a predetermined ratio is casted to obtain an ingot containing rare earth compounds (R—Fe—B based intermetallic compounds). The resultant ingot is coarsely pulverized into particles having a diameter of about 10 to 100 μm using a stamp mill or similar machines, and thereafter, the particles are finely pulverized into particles having a diameter of about 0.5 to 5 μm using a ball mill or similar machines to obtain magnetic powder containing rare earth compounds.

The rare earth element includes one or more types of elements selected from a group consisting of scandium (Sc), yttrium (Y), and lanthanoid, which belong to group III of the long form periodic table. The lanthanoid includes lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu).

Among the elements as described above, the rare earth element preferably includes at least one type of elements selected from Nd, Pr, Ho, and Tb, or at least one type of elements selected from La, Sm, Ce, Gd, Er, Eu, Tm, Yb, and Y.

Examples of the R—Fe—B based intermetallic compound include a Nd—Fe—B based compound represented by $Nd_2Fe_{14}B$. The rare earth compound contained in the magnetic powder is not limited to the R—Fe—B based intermetallic compound and may be, for example, a Sm—Co based compound represented by $SmCo_5$ and $Sm_2Co_{17}$ or a Sm—Fe—N based compound.

In the kneading, a clayey kneaded product (compound) is prepared by kneading the magnetic powder and the oil-extended rubber. The content of the magnetic powder in the kneaded product is preferably 80 to 95% by mass, and more preferably 88 to 92% by mass. When the content becomes too large, the degree of orientation tends to decrease, and it tends to be difficult to obtain the molded body having sufficient shape retainability. In contrast, when the content becomes too small, the kneaded product becomes sticky, and thus, its handling tends to be difficult. Kneading can be performed using a commercial kneading apparatus such as a kneader.

In the molding, the molded body is produced by molding the kneaded product in a magnetic field. The molding method is not particularly limited and can employ various methods such as extrusion molding, injection molding, and pressure molding. The production method of the present embodiment can produce a molded body by extrusion molding. The extrusion molding enables molded bodies in various shapes to be mass-produced easily in high yield.

The extrusion molding can be performed using a common extruder. During this process, the magnetic particles can be oriented by the magnetic fields while extrusion molding is performed, for example, by applying magnetic fields near an extrusion opening of an extruder. Such a method can apply magnetic fields in a state where the molded body is not pressurized, and therefore, magnetic particles (primary particles) easily move by synergism with lubrication action of oil to be easily oriented in order. As a result, an anisotropic rare earth sintered magnet having a sufficiently high degree of orientation can be produced. The intensity of magnetic fields to be applied can be, for example, 800 to 1600 kA/m. Molded bodies in various shapes such as cylinder shapes and sheet forms can be produced by changing the shape of the extrusion opening of a molding machine used for the extrusion molding.

In the removing of the oil-extended rubber, the oil-extended rubber contained in the molded body is removed by applying heat and/or reducing the pressure. The content of carbon remaining in the rare earth sintered magnet can be reduced by the removing of the oil-extended rubber. The removing of the oil-extended rubber may be performed by being divided into two processes of removing mainly the oil and removing mainly the rubber. Typically, oil can easily be removed as compared with rubber, and therefore, the removing of the oil can be performed at a heating temperature lower than that in the removing of the rubber. Even when oil containing oxygen as a constituent element in the molecule thereof is used as the oil, oxidization of the magnetic powder can sufficiently be suppressed by performing such two processes.

The removing of the oil can be performed by, for example, heating the molded body at 80 to 150° C. for 0.5 to 5 hours under a reduced pressure in which the pressure is 10 kPa or less or in a vacuum. The oil can be removed from the molded body by applying heat under such a condition. When the oil-extended rubber contains an organic solvent, the organic solvent can also be removed. In the removing of the oil, there is no need to remove the whole oil contained in the molded body, and a part of the oil may only be removed. The oil left unremoved in the removing of the oil can be removed in the removing of the rubber described later.

Decomposition of a part of the rubber and removal of the decomposed product generated by the decomposition may progress in the removing of the oil. The rate of temperature increase in the removing of the oil is preferably 1 to 30° C./min, and more preferably 5 to 20° C./min. As a result of this, while the limitation of equipment can be avoided, the extension of process can be suppressed, and thus, the oil can efficiently be removed from the molded body. The rate of temperature increase in the present specification can be obtained by dividing the temperature difference between before temperature increase and after temperature decrease by time required for temperature increase.

The removing of the rubber can be performed by, for example, gradually increasing temperature from room temperature to 400 to 600° C., and then keeping the temperature at 400 to 600° C. for 0 to 10 hours as needed. The keeping after temperature increase may not always be performed. By applying heat under such a condition, the rubber is removed from the molded body as it is or removed from the molded body after thermally decomposed.

The rate of temperature increase in the removing of the rubber is preferably 5° C./hr or more, and more preferably 20 to 200° C./hr. When the rate of temperature increase is too fast, the decomposition of the rubber and the removal of the decomposed product tend to be difficult to smoothly progress. As a result, the content of carbon derived from the decomposition of the rubber in the rare earth sintered magnet tends to increase. In contrast, when the rate of temperature increase is too slow, the process requires a long time, and therefore, the productivity tends to decrease.

The removing of the rubber may be performed under pressure comparable to atmospheric pressure and under hydrogen gas atmosphere or argon gas atmosphere, or be performed under a reduced pressure of 10 kPa or less or in a vacuum. The decomposition of the rubber and the removal of the decomposed product can smoothly be performed by the removing of the rubber under such a condition. When the removing of the rubber is performed under hydrogen gas atmosphere, a part of the main chains of polymers constituting the rubber can be decomposed to make the polymers become low molecular compounds, and a rare earth sintered magnet in which the content of carbon is further reduced can be obtained.

The removing of the oil-extended rubber is not limited only to the two-stage processes as described above. For example, a process corresponding to the removing of the rubber alone may be performed without performing the removing of the oil, thereby simultaneously removing the oil and the rubber.

In the calcining, the molded body from which the solvent is removed is calcined to obtain a rare earth sintered magnet. The calcination was performed by, for example, heating the molded body at 1000 to 1200° C. for 1 to 10 hours in a heating furnace under reduced pressure, in a vacuum, or under inert gas atmosphere, and then allowing the resultant molded body to cool to room temperature, thereby enabling the production of the rare earth sintered magnet.

The rare earth sintered magnet obtained in the calcining can be processed into a desired shape and a size as needed. The rare earth sintered magnet may be subjected to aging treatment described later as needed.

In the aging treatment, the sintered body obtained in the calcining is heated at a heating temperature lower than that in the calcining. The aging treatment is performed, for example, under conditions such as two-stage heating in which the sintered body is heated at 700 to 900° C. for 1 to 3 hours and then is heated at 400 to 700° C. for 1 to 3 hours, and one-stage heating in which the sintered body is heated at about 600° C. for 1 to 3 hours. The magnetic properties of the rare earth sintered magnet can be improved by such aging treatment.

FIG. 1 is a perspective view showing an example of a rare earth sintered magnet obtained by the production method of the present embodiment. A rare earth sintered magnet 10 is obtained by performing molding in a magnetic field by which magnetic fields are applied during extrusion molding, and thus has a high degree of orientation. The rare earth sintered magnet 10 has, for example, a degree of orientation of 95 to 97% and thus has high residual magnetic flux density. Moreover, although the rare earth sintered magnet 10 is produced by using a molded body obtained from a kneaded product of oil-extended rubber and magnetic powder, the amount of carbon remaining in the molded body is sufficiently reduced in the removing of the oil-extended rubber. Therefore, the rare earth sintered magnet 10 has excellent coercive force. In terms of further improving the coercive force of the rare earth sintered magnet 10, the carbon content of the rare earth sintered magnet 10 is preferably 0.8% by mass or less, and more preferably 0.5% by mass or less.

When the rare earth sintered magnet 10 is a sintered magnet containing a Nd—Fe—B based intermetallic compound as a rare earth compound, the content ratio of the Nd—Fe—B based intermetallic compound is preferably 90% by mass or more, more preferably 95% by mass or more, and further preferably 99% by mass or more. When the content ratio of the Nd—Fe—B based intermetallic compound decreases, it tends to be difficult to obtain excellent magnetic properties.

The content ratio of the rare earth elements in the rare earth sintered magnet 10 is preferably 8 to 40% by mass, and more preferably 15 to 35% by mass. When the content ratio of the rare earth elements is less than 8% by mass, it tends to be difficult to obtain the rare earth sintered magnet 10 having high coercive force. In contrast, when the content ratio of the rare earth elements exceeds 40% by mass, an k-rich non-magnetic phase increases, and the residual magnetic flux density of the rare earth sintered magnet 10 tends to decrease.

The content ratio of Fe in the rare earth sintered magnet 10 is preferably 42 to 90% by mass, and more preferably 60 to 80% by mass. When the content ratio of Fe is less than 42% by mass, Br in the rare earth sintered magnet 10 tends to decrease, but when the content ratio of Fe exceeds 90% by mass, the coercive force of the rare earth sintered magnet 10 tends to decrease.

The content ratio of B in the rare earth sintered magnet 10 is preferably 0.5 to 5% by mass. When the content ratio of B is less than 0.5% by mass, the coercive force of the rare earth sintered magnet 10 tends to decrease, but when the content ratio of B exceeds 5% by mass, a B-rich non-magnetic phase increases, and thus, the residual magnetic flux density of the rare earth sintered magnet 10 tends to decrease.

A part of Fe may be replaced by cobalt (Co). The temperature properties can be improved by this replacement without impairing the magnetic properties of the rare earth sintered magnet 10. A part of B may also be replaced by one or more types of elements selected from a group consisting of carbon (C), phosphorus (P), sulfur (S), and copper (Cu). The productivity of the rare earth sintered magnet 10 is improved, and thus the production cost can be reduced.

In terms of improving the coercive force of, improving the productivity of, and reducing costs of the rare earth sintered magnet 10, the rare earth sintered magnet 10 may include, as an optional element, one or more types of elements among, for example, aluminum (Al), titanium (Ti), vanadium (V), chromium (Cr), manganese (Mn), bismuth (Bi), niobium (Nb), tantalum (Ta), molybdenum (Mo), tungsten (W), antimony (Sb), germanium (Ge), tin (Sn), zirconium (Zr), nickel (Ni), silicon (Si), gallium (Ga), copper (Cu), and/or hafnium (Hf).

The rare earth sintered magnet 10 may include, for example, as inevitable impurities, oxygen (O), nitrogen (N), carbon (C), and/or calcium (Ca). Such a rare earth sintered magnet 10 can suitably be used for, for example, a rotating element of an electric apparatus.

The production method of the present embodiment allows the processes until the molding to be performed at room temperature, further can employ extrusion molding as the molding method, and thus can mass-produce rare earth sintered magnets having various shapes and a high degree of orientation easily in high yield. Oxidization of magnet powder containing rare earth compounds can be sufficiently suppressed because molded bodies can be produced without applying heat, and thus, rare earth sintered magnets further excellent in magnetic properties can be produced.

Although exemplary embodiments of the present invention have been described above, the embodiments as described above are not intended to unreasonably limit the scope of the present invention.

EXAMPLES

While the present invention will now be described in more detail with reference to Examples and Comparative Examples, Examples described below are not intended to limit the scope of the present invention.

Example 1

Preparing Process

<Preparation of Oil-Extended Rubber>

70 g of ethylene propylene (trade name: EP11, manufactured by JSR Corporation) and 1120 g of toluene were blended, and the resultant mixture was stirred using a homojetter (manufactured by Tokushu Kika Kogyo Co., Ltd.) under conditions of a stirring rotation speed of 5000 rpm and a stirring time of 75 minutes to obtain 1190 g of a solution.

420 g of isoparaffin (trade name: Isoper M, manufactured by Exxon Mobil Corporation) was added to the solution, and the resultant solution was stirred using the homojetter described above under conditions of a stirring rotation speed of 5000 rpm and a stirring time of 45 minutes to obtain a solution. The solution was stirred in a vacuum using a Three-One Motor (manufactured by Shinto Scientific Co., Ltd.) under conditions of a stirring rotation speed of 300 rpm and a drying time of 6 hours to evaporate toluene, whereby 490 g of oil-extended rubber was prepared.

<Preparation of Nd—Fe—B Based Powder>

A Nd—Fe—B based alloy having the following composition was prepared as a rare earth compound by strip casting.

Nd: 30% by mass
Co: 1M % by mass
Cu: 0.1% by mass
Al: 0.2% by mass
B: 1.0% by mass
Zr: 0.2% by mass
Fe: the balance (inevitable impurities included)

The Nd—Fe—B based alloy as described above was coarsely pulverized by a rotary kiln in a hydrogen gas atmosphere of 100 kPa and then was subjected to dehydrogenation treatment in an argon gas atmosphere of 100 kPa at a temperature of 600° C. to obtain coarsely pulverized powder. 0.1% by mass of zinc stearate was added to this coarsely pulverized powder, and the mixture was pulverized by a jet mill in $N_2$ gas flow to obtain Nd—Fe—B based alloy powder having an average particle diameter of 4 μm.

Kneading Process 70 g of the oil-extended rubber prepared in the manner as described above was added to 560 g of the obtained Nd—Fe—B based alloy powder, and the mixture was kneaded using a planetary mixer (trade name: HIVIS MIX, manufactured by PRIMIX Corporation) under conditions of a rotation speed of 50 rpm and a kneading time of 30 minutes to obtain 630 g of a compound that was a kneaded product of the oil-extended rubber and the Nd—Fe—B based alloy powder.

Molding Process

Extrusion molding of the kneaded product as described above was performed while a magnetic field of 1200 kA/m was applied using an extruder (trade name: Labo Plastomill, manufactured by Toyo Seiki Seisaku-sho, Ltd., nozzle size: 18 mm high×12 mm wide) in a longitudinal direction of the nozzle under conditions of a rotation speed of 50 rpm and a cylinder temperature of 25° C. to obtain a prismatic molded body. This molded body was cut using a wire cutter to a length of 20 mm to produce a molded body having a dimension of 20 mm high×18 mm wide×12 mm thick. The content of the magnetic powder in the molded boy was as indicated in Table 1.

Removing Process of Oil-Extended Rubber

Fifteen produced molded bodies were placed on a tray having a dimension of 150 mm high×150 mm wide×150 mm thick, and the removing process of the oil and the removing process of the rubber described below were sequentially performed.

<Removing Process of the Oil>

The temperature of each of the molded bodies was elevated from room temperature to 100° C. at 10° C./min using a first electric furnace while argon gas was flown at 6 L/min in an argon gas atmosphere of 100 kPa. The temperature was maintained at 100° C. for 50 minutes, then air in the electric furnace was exhausted, and the temperature was maintained at 100° C. for 1.5 hours under reduced pressure (≦1 kPa). Subsequently, the molded body was allowed to cool to room temperature.

<Removing Process of the Rubber>

The temperature of the molded body was elevated from room temperature to 500° C. over 4 hours using a second electric furnace while hydrogen gas was flown at 1 L/min in a hydrogen gas atmosphere of 100 kPa (rate of temperature increase: 120° C./hr). After the temperature increase, the molded body was allowed to cool to room temperature to obtain a degreased body.

Calcining Process

The temperature of the obtained degreased body was elevated to 1050° C. at 10° C./min using a third electric furnace under reduced pressure (≦1 kPa). After the temperature was maintained at 1050° C. for 4 hours, the degreased body was allowed to cool to room temperature while argon gas was flown at 6 L/min to obtain a sintered body.

Aging Treatment Process

The temperature of the obtained sintered body was elevated to 800° C. at 10° C./min using a fourth electric furnace while argon gas was flown at 6 L/min. The temperature was maintained at 800° C. for 1 hour, and then, the sintered body was allowed to cool to room temperature. Subsequently, the temperature was elevated to 500° C. at a rate of temperature increase of 10° C./min while argon gas was flown at 6 L/min and was maintained at 500° C. for 1 hour. Subsequently, the sintered body was cooled to room temperature to obtain a rare earth sintered magnet of Example 1.

Evaluation of Rare Earth Sintered Magnet

The relative density of the rare earth sintered magnet produced in the manner as described above was measured by the Archimedes method. A residual magnetic flux density (Br) and a coercive force (HcJ) of the rare earth sintered magnet were measured using a B-H tracer. The carbon content in the rare earth sintered magnet was measured by an infrared absorption method after combustion in high-frequency induction. Specifically, the rare earth sintered magnet was pulverized using a stamp mill to prepare 0.1 g of pulverized powder as a measurement sample. The carbon content in the measurement sample was measured using a quantitative analysis apparatus for carbon (trade name: EMIA-920, manufactured by HORIBA, Ltd.) in oxygen flow. Table 1 shows the evaluation result.

Examples 2 to 20

Rare earth sintered magnets were produced in a similar manner to that of Example 1 except that at least one of the type of rubbers, the type of magnetic powder, the compounding ratio of raw materials, and temperature increase time in the removing process of the rubber was changed as indicated in Table 1, and the evaluation of the rare earth sintered magnets was performed in a similar manner to that of Example 1. Table 1 shows both the production conditions and evaluation results of the rare earth sintered magnets. In Example 20, Sm—Co based powder used instead of the Nd—Fe—B based powder was prepared as described below.

<Preparation of Sm—Co Based Powder>

A Sm—Co based alloy having the following composition was prepared as a rare earth compound by strip casting.

Sm: 26.4% by mass

Fe: 15.9% by mass

Cu: 7.4% by mass

Zr: 2.2% by mass

Co: the balance (inevitable impurities included)

The Sm—Co based alloy as described above was coarsely pulverized by a rotary kiln in a hydrogen gas atmosphere of 100 kPa and then was subjected to dehydrogenation treatment in an argon gas atmosphere of 100 kPa at a temperature of 600° C. to obtain coarsely pulverized powder. 0.1% by mass of zinc stearate was added to this coarsely pulverized powder, and the mixture was pulverized by a jet mill in $N_2$ gas flow to obtain Sm—Co based alloy powder having an average particle diameter of 4 μm.

Comparative Examples 1 to 3

At least one of the type of rubbers, the compounding ratio of raw materials, and temperature increase time in the removing process of the rubber was changed as indicated in Table 1. In Comparative Examples 1 and 2 in which polyethylene or polypropylene was used as a thermoplastic binder, extrusion molding was performed while applying heat in the molding process. Except these, the rare earth sintered magnets were produced in a similar manner to that of Example 1, and the evaluation of the rare earth sintered magnets was performed in a similar manner to that of Example 1. Table 1 shows both the production conditions and evaluation results of the rare earth sintered magnets.

TABLE 1

| | Type of rubber or thermoplastic binder (*1) | Compounding ratio of raw materials (*2) | | | | | Content of magnetic powder (*3) (% by mass) | Rate of temperature increase (*4) (° C./hr) | Evaluation of rare earth sinfered magnet | | | |
|---|---|---|---|---|---|---|---|---|---|---|---|---|
| | | Magnetic powder | | Isoparaffin | Rubber | Toluene | | | Carbon content (% by mass) | Relative density (%) | HoJ (kOe) | Br (kG) |
| Example 1 | EPM | 56 | Nd—Fe—B based | 6 | 1 | 16 | 88.9 | 120 | 0.14 | 99.0 | 7.6 | 14.3 |
| Example 2 | EPM | 63 | Nd—Fe—B based | 6 | 1 | 16 | 90.0 | 120 | 0.12 | 99.1 | 8.8 | 14.2 |
| Example 3 | EPM | 70 | Nd—Fe—B based | 6 | 1 | 16 | 90.9 | 120 | 0.12 | 99.3 | 9.0 | 14.1 |
| Example 4 | EPM | 56 | Nd—Fe—B based | 6 | 1 | 16 | 88.9 | 30 | 0.08 | 99.3 | 7.5 | 14.4 |
| Example 5 | EPM | 63 | Nd—Fe—B based | 6 | 1 | 16 | 90.0 | 30 | 0.07 | 99.3 | 8.9 | 14.2 |
| Example 6 | EPM | 70 | Nd—Fe—B based | 6 | 1 | 16 | 90.9 | 30 | 0.07 | 99.4 | 9.3 | 14.1 |
| Example 7 | EPM | 56 | Nd—Fe—B based | 6 | 1 | 16 | 88.9 | 7.5 | 0.04 | 99.5 | 9.0 | 14.4 |
| Example 8 | EPM | 63 | Nd—Fe—B | 6 | 1 | 16 | 90.0 | 7.5 | 0.04 | 99.5 | 10.7 | 14.2 |

TABLE 1-continued

| | Type of rubber or thermoplastic binder (*1) | Compounding ratio of raw materials (*2) Magnetic powder | | Isoparaffin | Rubber | Toluene | Content of magnetic powder (*3) (% by mass) | Rate of temperature increase (*4) (° C./hr) | Evaluation of rare earth sinfered magnet Carbon content (% by mass) | Relative density (%) | HoJ (kOe) | Br (kG) |
|---|---|---|---|---|---|---|---|---|---|---|---|---|
| Example 9 | EPM | 70 | based Nd—Fe—B based | 6 | 1 | 16 | 90.9 | 7.5 | 0.02 | 99.5 | 11.0 | 14.1 |
| Example 10 | SBR | 63 | Nd—Fe—B based | 6 | 1 | 7 | 90.0 | 30 | 0.40 | 91.9 | 5.4 | 13.0 |
| Example 11 | SBR | 70 | Nd—Fe—B based | 6 | 1 | 7 | 90.9 | 30 | 0.49 | 90.3 | 5.8 | 12.6 |
| Example 12 | SBR | 56 | Nd—Fe—B based | 6 | 1 | 7 | 88.9 | 7.5 | 0.55 | 96.9 | 6.1 | 13.9 |
| Example 13 | SBR | 63 | Nd—Fe—B based | 6 | 1 | 7 | 90.0 | 7.5 | 0.55 | 95.5 | 6.0 | 13.5 |
| Example 14 | EPM | 56 | Nd—Fe—B based | 5 | 1 | 16 | 90.3 | 120 | 0.19 | 98.4 | 6.8 | 13.6 |
| Example 15 | EPM | 56 | Nd—Fe—B based | 7 | 1 | 16 | 87.5 | 120 | 0.13 | 99.4 | 7.9 | 14.4 |
| Example 16 | EPM | 56 | Nd—Fe—B based | 9 | 1 | 16 | 84.8 | 120 | 0.12 | 99.5 | 8.8 | 13.6 |
| Example 17 | PIB | 63 | Nd—Fe—B based | 1 | 1 | 0 | 96.9 | 30 | 0.07 | 99.3 | 8.9 | 14.1 |
| Example 18 | IR | 63 | Nd—Fe—B based | 6 | 1 | 16 | 90.0 | 30 | 0.10 | 99.3 | 8.8 | 13.0 |
| Exiuitple 19 | BR | 63 | Nd—Fe—B based | 6 | 1 | 16 | 90.0 | 30 | 0.15 | 99.1 | 8.1 | 12.0 |
| Example 20 | EPM | 63 | Sm—Co based | 6 | 1 | 16 | 90.0 | 30 | 0.07 | 99.1 | 8.7 | 10.6 |
| Comparative Example 1 | PE | 63 | Nd—Fe—B based | 6 | 1 | 16 | 90.0 | 30 | 0.07 | 99.1 | 0.2 | 0.7 |
| Comparative Example 2 | PP | 63 | Nd—Fe—B based | 6 | 1 | 16 | 90.0 | 30 | 0.07 | 99.1 | 0.2 | 0.5 |
| Comparative Example 3 | EPM | 63 | Nd—Fe—B based | 0 | 1 | 16 | 90.0 | — | — | — | — | — |

*1: EPM denotes ethylene-propylene rubber, SBR denotes styrene-butadiene rubber, PIB denotes polyisobutylene rubber, IR denotes isoprene rubber, BR denotes butadiene rubber, PE denotes polyethylene, and PP denotes polypropylene.
*2: Mass ratio based on rubber
*3: Content in the molded bodies
*4: The rate of temperature increase in the removing of the rubber (temperature difference between before temperature increase and after temperature decrease/time required for temperature increase)

As a result indicated in Table 1, the rare earth sintered magnet had higher relative density and lower carbon content when ethylene-propylene rubber (EPM) was used than when styrene-butadiene rubber (SBR) was used as rubber. The reason for this can be considered that the decomposition of the polymer and the removal of the decomposed product generated by the decomposition smoothly progress by using EPM having no benzene ring than using SBR having a benzene ring in the molecule structure of the polymer constituting the rubber. As results of Examples 1 to 9, it was confirmed that the carbon content was able to be reduced when the rate of temperature increase was slow in the removing of the rubber. The reason for this can be considered that the decomposition of the rubber in the molded body and the removal of the decomposed product tend to smoothly progress by slowing down the rate of temperature increase.

Results of Examples 1 to 9 revealed that the carbon contents were low when the contents of magnetic powder in the molded bodies were high, which led to obtaining rare earth sintered magnets having high HcJ. As results of Examples 1, 14 to 16, it was confirmed that rare earth sintered magnets having a further high degree of orientation (high Br) were obtained by setting the compounding ratio of oil relative to rubber (mass ratio) to 6 to 7. The oxygen contents in the rare earth sintered magnets of Comparative Examples 1 and 2 that were measured by performing thermal decomposition gas chromatography-mass spectrometry (GC-MS) analysis were 11,000 ppm and 15,000 ppm, respectively. In Comparative Example 3 in which no isoparaffin was used for preparing the oil-extended rubber, a molded body was not able to be produced in the molding process, and thus, a rare earth sintered magnet was not able to be produced.

What is claimed is:

1. A method for producing a rare earth sintered magnet, the method comprising the steps of:

molding a mixture of magnetic powder containing a rare earth compound and oil-extended rubber containing oil and rubber to produce a molded body;

removing the oil-extended rubber from the molded body; and calcining the molded body from which the oil-extended rubber is removed to produce a rare earth sintered magnet, wherein the rubber is at least one selected from a group consisting of polyisobutylene, ethylene-propylene rubber, styrene-butadiene rubber, butadiene rubber, isoprene rubber, butyl rubber and ethylene-propylene diene monomer rubber.

2. The method for producing a rare earth sintered magnet according to claim 1, wherein in the molding, the molded body is produced by extrusion-molding the mixture.

3. The method for producing a rare earth sintered magnet according to claim 1, wherein the rubber is made of a polymer containing no oxygen as a constituent element.

4. The method for producing a rare earth sintered magnet according to claim 1, wherein the rubber is made of a polymer in which bonds between carbons are only single bonds.

5. The method for producing a rare earth sintered magnet according to claim 1, wherein the content of the magnetic powder in the mixture is 80 to 95% by mass.

6. The method for producing a rare earth sintered magnet according to claim 1, wherein the removing of the oil-extended rubber comprises the steps of removing mainly the oil from the molded body by heating the molded body, and removing mainly the rubber from the molded body by heating the molded body.

* * * * *